US005133893A

United States Patent [19]

Thom et al.

[11] Patent Number: 5,133,893

[45] Date of Patent: * Jul. 28, 1992

[54] ENZYMATIC DETERGENT COMPOSITION

[75] Inventors: David Thom, Voorburg; Ton Swarthoff, Hellevoetsluis; Jan Maat, Monster, all of Netherlands

[73] Assignee: Lever Brothers Company, New York, N.Y.

[ * ] Notice: The portion of the term of this patent subsequent to Nov. 17, 2004 has been disclaimed.

[21] Appl. No.: 726,639

[22] Filed: Jul. 2, 1991

Related U.S. Application Data

[63] Continuation of Ser. No. 366,226, Jun. 12, 1989, abandoned, which is a continuation of Ser. No. 205,056, Jun. 3, 1988, abandoned, which is a continuation of Ser. No. 58,649, Jun. 3, 1987, abandoned, which is a continuation-in-part of Ser. No. 870,260, Jun. 3, 1986, abandoned.

[30] Foreign Application Priority Data

Jun. 11, 1985 [GB] United Kingdom ..... 8514708

[51] Int. Cl.[5] ..... C11D 3/386; C11D 3/395; C11D 7/42

[52] U.S. Cl. ..... 252/99; 252/94; 252/95; 252/174.12; 252/DIG. 12; 435/198; 435/264

[58] Field of Search ..... 252/174.12, DIG. 12, 252/94, 95, 99; 435/198, 264

[56] References Cited

U.S. PATENT DOCUMENTS

| | | | |
|---|---|---|---|
| 3,451,935 | 6/1969 | Roald et al. | 252/135 |
| 3,594,325 | 7/1971 | Feierstein et al. | 252/138 |
| 3,950,277 | 4/1976 | Stewart et al. | 252/DIG. 12 |
| 4,011,169 | 3/1977 | Diehl et al. | 252/174.12 |
| 4,066,508 | 1/1978 | Rauscher et al. | 435/198 |
| 4,421,664 | 12/1983 | Anderson et al. | 252/174.12 |
| 4,707,291 | 11/1987 | Thom et al. | 252/174.12 |
| 4,769,173 | 9/1988 | Cornelissen et al. | 252/174.12 |
| 4,810,414 | 3/1989 | Huge-Jensen et al. | 252/174.12 |
| 4,861,509 | 8/1989 | Cornelissen et al. | 252/174.12 |
| 4,873,016 | 10/1989 | Thom et al. | 252/174.12 |
| 4,876,024 | 10/1989 | Enomoto et al. | 252/174.12 |
| 4,933,287 | 6/1990 | Farin et al. | 252/174.12 |
| 4,950,417 | 8/1990 | Bycroft et al. | 252/174.12 |

FOREIGN PATENT DOCUMENTS

| | | | |
|---|---|---|---|
| 0045032 | 3/1982 | European Pat. Off. | 435/198 |
| 130064 | 1/1985 | European Pat. Off. . | |
| 5320487 | 2/1978 | Japan . | |
| 1210997 | 11/1970 | United Kingdom . | |
| 1372034 | 10/1974 | United Kingdom . | |
| 1442418 | 7/1976 | United Kingdom . | |
| 1442419 | 7/1976 | United Kingdom . | |
| 2124244 | 2/1984 | United Kingdom | 252/174.12 |
| 1590737 | 6/1987 | United Kingdom . | |

OTHER PUBLICATIONS

"Methods in Enzymology" vol. VI, 1963, pp. 848–852 ed. by Sidney Colowick and Nathan O. Kaplan.

*The Journal of Applied Biochemistry* 2 (1980) pp. 218–229.

*Acta Med. Scan,* 133 pp. 76–79 (1950), Ouchterlony.

Technical Leaflet, Amano Pharmaceutical Company.

*Primary Examiner*—Paul Lieberman
*Assistant Examiner*—Linda D. Skaling
*Attorney, Agent, or Firm*—Ronald A. Koatz

[57] ABSTRACT

The invention relates to a detergent composition comprising lipases. By inclusion of a certain immunologically defined class of lipases in a detergent composition which comprises as detergent-active material solely an anionic synthetic detergent, and as builder a water-soluble inorganic or organic builder salt, an improved overall detergency is obtained. The builder salt is typically sodium tripolyphosphate or sodium carbonate, and the lipase is typically obtained from certain Pseudomonas or Chromobacter strains.

6 Claims, No Drawings

ENZYMATIC DETERGENT COMPOSITION

This is a continuation application of Ser. No. 07/366,226, filed Jun. 12, 1989, now abandoned which is a continuation application of Ser. No. 205,056, filed Jun. 3, 1988, which is a Continuation application of Ser. No. 058,649, filed Jun. 3, 1987, now abandoned; which is a continuation-in-part application of Ser. No. 870,260, filed Jun. 3, 1986, now abandoned.

The present invention relates to an enzymatic detergent composition. More particularly it relates to an enzymatic detergent composition which contains a lipolytic enzyme.

Enzymatic detergent compositions are well known in the art. Enzymes of many types have been proposed for inclusion in detergent compositions, but the main attention has been focussed on proteases and amylases. Although lipases have been mentioned as possible enzymes for detergent compositions, there is relatively little prior art directly concerned with lipases for detergent compostions in general. Thus, our British Patent Specification 1,372,034 discloses the use of lipases produced by microorganisms of the Pseudomonas group, such as *Pseudomonas stutzeri* ATCC 19.154, in detergent compositions for soaking fabrics which contain specific nonionic detergent actives, optionally with a specific anionic detergent active. However, it was made clear that "the mere addition of lipoytic enzymes to any and all detergent compositions does not produce, (as was shown) a satisfactory and acceptable detergent composition both regarding the enzyme activity and the cleaning efficiency. Various ingredients of detergent compositions have been found to exert a negative influence on lipolytic enzymes".

In British Patent Specifications 1,442,418 and 1,442,419 a two-stage laundering process is described wherein a soaking step with a lipase-containing liquor is followed by a washing step with a detergent-containing wash liquor.

In specification 1,442,419 the "lipase-containing liquor" consisted of the claimed lipase(s) and a water soluble borax salt. Optional inclusion of conventional detergent surfactants or builders was mentioned but effectiveness in the presence of surfactants and builders was not demonstrated. In specification 1,442,418 the "lipase-containing liquor" consisted of the claimed lipase(s) plus borax and $Ca^{++}$ or $Mg^{++}$ ions. Surfactants were again mentioned but again no evidence relating to effectiveness in surfactant solutions was provided. Builders which bind $Ca^{++}$ and/or $Mg^{++}$ ions were specifically excluded in these pre-wash liquors. Overall, the wash process described by these specifications needed two separate formulated products; it was cumbersome and it would be of limited applicability in practice.

In a more recent article in Journal of Applied Biochemistry, 2 (1980), pages 218–229, Andree et al. report on their investigations of lipases as detergent components. They concluded that the two tested commercially available lipases (pancreatic lipase and Rhizopus lipase) were unstable in solutions of active systems containing mixtures of typical detergent anionic and nonionic surfactants. They deduced that the lipases were inactivated by the presence of the anionic detergents, the pancreatic lipase somewhat less so than the Rhizopus lipase. Andree et al. further concluded that the tested lipases can improve the washing efficiency of full nonionic detergent formulations but that this improvement can be matched by increasing the concentrations of nonionic active in detergent formulations.

A recently published European patent application, No. 0130064, describes the use of a lipase from *Fusarium oxysporum* as detergent additive. The detergent compositions exemplified in this patent application contain a nonionic and an anionic detergent, or consist solely of a nonionic detergent.

The above prior art therefore either teaches to use a specific lipase in detergent compositions, or to formulate specific detergent compositions and/or wash regimes for inclusion of lipases therein.

It is an object of the present invention to provide lipase-containing detergent compositions which have an improved overall detergency performance and which show significant detergency improvements by the inclusion of lipases therein.

We have now discovered that the inclusion of a certain class of lipases in a built detergent composition which contains as detergent-active material solely an anionic synthetic detergent and as builder a water-soluble organic and/or inorganic builder salt provides an improved overall detergency.

In contrast with the above prior art, complete, lipase-containing detergent compositions are provided by the present invention with which a normal washing process can be carried out, also at lower temperatures, whereby the benefits of the lipases are obtained without having to resort to special carefully selected detergent compositions or special washing or soaking steps or without having to treat the fabrics for long periods with the lipase-containing composition.

The class of lipases to be used according to the present invention embraces those lipases which show a positive immunological cross-reaction with the antibody of the lipase, produced by the microorganism *Pseudomonas fluorescens* IAM 1057. This lipase and a method for its purification have been described in Japanese Patent Application 53-20487, laid open to public inspection on Feb. 24, 1978. This lipase is available from Amano Pharmaceutical Co. Ltd, Nagoya, Japan, under the trade name Lipase P "Amano", hereinafter referred to as "Amano-P". The lipases of the present invention should show a positive immunological cross reaction with the Amano-P antibody, using the standard and well-known immunodiffusion procedure according to Ouchterlony (Acta. Med. Scan., 133, pages 76–79 (1950)).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in complete Freund's
day 60: booster of antigen in incomplete Freund's adjuvant The serum containing the required antibody is prepared by centrifugation of clotted blood, taken on day 67.

The titre of the anti-Amano-P-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All lipases showing a positive immunological cross reaction with the Amano-P antibody as hereabove described are lipases according to the present invention. Typical examples thereof are lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from US Biochemical Corp., U.S.A. and Diosynth Co., The Netherlands, and lipases ex *Pseudomonas gladioli.*

Preferably, the lipases of the present invention should also show a positive immunological cross reaction with the antibody of one of the following lipases: lipase ex *Chromobacter viscosum* var. *lipolyticum* NRRLB 3673, as sold by Toyo Jozo Co., Tagata, Japan, and lipase ex *Pseudomonas gladioli.*

Certain lipases are known as useful in cleaning compositions that contain anionic detergent-active material and builder salts such as sodium carbonate. For instance, the Technical Leaflet of the Amano Pharmaceutical Company reports detergent compositions incorporating the enzymes Amano-B and Amano-CES which are lipases produced by *Pseudomonas fragi* and *Pseudomonas nitroreducens* var. *lipolyticum*, respectively. These enzymes have been found to exhibit a positive immunological cross-reaction with the antibody of the lipase produced by the microorganism *Pseudomonas fluorescens* IAM 1057. For purposes of the present invention, however, the lipases produced by *Pseudomonas fragi* and *Pseudomonas nitroreducens* are not to be considered within the claimed class of enzymes.

The lipases of the present invention are included in the detergent composition in such an amount that the final detergent composition has a lipolytic enzyme activity of from 100 to 0.005 LU/mg preferably 25 to 0.05 LU/mg of the composition.

A Lipase Unit (LU) is that amount of lipase which produces 1 /umol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol $Ca^{2+}$ and 20 mmol NaCl in 5 mmol Tris-buffer.

Naturally, mixtures of the above lipases can be used. The lipases can be used in their impurified form, or in a purified form, e.g. purified with the aid of well-known adsorption methods, such as a phenylsepharose-packed column technique.

The detergent composition incorporating the lipases of the present invention contains as active detergent material solely one or more anionic synthetic detergent-active materials. This type of detergent-active materials is well known in the art, and suitable examples are fully described in Schwartz, Perry and Berch, Surface-Active Agents and Detergents, Vol. I (1949) and Vol. II (1958).

The amount of anionic detergent-active material in the detergent composition ranges from 1 to 40%, usually 2 to 35% and preferably 5 to 30% by weight.

The detergent composition furthermore contains from 1-55%, preferably from 5-30% by weight of one or more organic and/or inorganic water-soluble builder salts. Typical examples thereof are alkali metal ortho-, -pyro-and polyphosphates, alkali metal carbonates, alkali metal citrates, alkali metal nitrilotriacetates and so on, and mixtures of various different water-soluble builder salts. Preferably pentasodium tripolyphosphate and sodium carbonate and mixtures thereof are used. Furthermore, it may contain from 1-35% of a bleaching agent or a bleaching system comprising bleaching agent and an activator therefor. In this respect it has been surprisingly found that the lipases of the present invention often are significantly less affected by the bleaching agent or bleaching system in the composition than other lipases, not according to the invention.

The compositions may furthermore comprise lather boosters, foam depressors, anti-corrosion agents, soil-suspending agents, sequestering agents, anti-soil redeposition agents, perfumes, dyes, stabilising agents for the enzymes and bleaching agents and so on. They may also comprise enzymes other than lipases, such as proteases, amylases, oxidases and cellulases. In this respect it has surprisingly been found that, although the lipases of the present invention rapidly lose activity in the presence of proteases in clean model systems, under practical wash conditions in washing machines a substantial benefit is still delivered by the lipases in the presence of proteases.

The compositions of the present invention can be formulated in any desired form, such as powders, bars, pastes, liquids etc.

As said before, the compositions of the present invention show an improved overall detergency performance, particularly at lower temperatures. It is surprising that fully formulated detergent compositions incorporating the lipases of the present invention do show such an improved overall performance, when the prior art hitherto has indicated that lipases would only give some effect under particular conditions.

The invention will now further be illustrated by way of Examples.

EXAMPLE 1

The following detergent compositions, with and without a lipase according to the present invention were tested in a washing test under the conditions mentioned below. The lipase used was Amano-P as heretofore described, used in a concentration of 15 LU/ml.

| | % weight | |
|---|---|---|
| | A | B |
| sodium alkylbenzenesulphonate | 24.0 | 28.0 |
| pentasodium tripolyphosphate | 15.0 | 2.1 |
| alkaline sodium silicate | 10.0 | 12.0 |
| sodium carboxymethylcellulose | 0.6 | 0.6 |
| sodium sulphate | 32.5 | 15.4 |
| fluorescer | 0.4 | 0.4 |
| sodium carbonate | 10.0 | 35.0 |
| miscellaneous + water | to 100% | to 100% |

The washing test was carried out under the following conditions:

Cotton test cloths soiled with a mixture containing inorganic pigments, protein, palm oil were soaked in a wash liquor containing 3.5 g/l of the detergent composition at 20° C., were subsequently hand washed for 1.5 minute and thereafter rinsed 3 times, each time for 2 minutes. After washing, the test cloths were soiled and washed again. The full soiling/washing procedure was repeated four times. The water hardness was 8° GH.

The liquor/cloth ratio during soaking, washing and rinsing was 9.3 and 20 respectively. After the fourth wash the reflectance of the test cloths and the residual percentage of fatty material on the test cloths were determined. The reflectance was measured in a Reflectometer at 460 nm with a UV filter in the light pathway and the fatty matter by extracting the dried test cloths with petroleum-ether, distilling off the solvent and weighing the resulting fatty matter.

The following results were obtained:

| Composition | $R^*_{460}$ | % FM |
|---|---|---|
| A: with lipase | 81.0 | 6.9 |
| without lipase | 79.7 | 8.1 |
| B: with lipase | 80.8 | 6.8 |
| without lipase | 79.6 | 8.3 |

EXAMPLE 2

The following compositions were compared in a multicycle soiled wash system in a Tergotometer under the following conditions:

agitation: 50 rpm
washing period: 10 minutes at room temperature
rinsing: 3×2 minutes
water hardness: 17° GH
protease concentration: 20 GU/ml
lipase concentration: 1 LU/ml
test cloth: cotton
soil: palm oil+milk powder The detergent compositions were as follows:

A.
30% sodium dodecylbenzenesulphonate
30% sodium sulphate
30% sodium tripolyphosphate
10% sodium silicate B. As A, but the sodium tripolyphosphate was replaced by zeolite.

The compositions were used in a concentration of 2 g/l.

The following results were obtained:

| Lipase | Protease | $R^*_{460}$ after 4th wash | | % FM after 4th wash | |
|---|---|---|---|---|---|
| | | A | B | A | B |
| — | — | 62.6 | 63.2 | 17.3 | 18.5 |
| Amano-P | — | 71.3 | 69.1 | 9.8 | 12.0 |
| Toyo Jozo | — | 70.5 | 70.0 | 9.6 | 11.5 |
| *Ps. gladioli* | — | 71.1 | 70.1 | 9.8 | 12.3 |
| — | Savinase | 64.1 | 63.1 | 15.7 | 17.4 |
| Amano-P | Savinase | 70.5 | 67.7 | 10.8 | 14.9 |
| Toyo Jozo | Savinase | 71.0 | 68.1 | 10.1 | 14.1 |
| *Ps. gladioli* | Savinase | 70.8 | 69.0 | 10.1 | 13.3 |

EXAMPLE 3

The following composition was tested in a Tergotometer (4 multicycle soiled washes) at 20° C. for 14 minutes in water of 8° GH. The concentration was 1.3 g/l. The lipase was the Toyo Jozo lipase, used in a concentration of 3 LU/ml, and the test cloths were cotton, polyester/cotton and polyester.

The composition was as follows:

15% linear $C_{12}$ alkylbenzenesulphonate
20% sodium silicate
35% sodium carbonate
25% sodium sulphate
5% minor ingredients and moisture The following results were obtained after the 4th wash (−L=without lipase; +L=lipase):

| Cotton | | | | Polyester/cotton | | | | Polyester | | | |
|---|---|---|---|---|---|---|---|---|---|---|---|
| $R^*_{460}$ | | Residual Fat | | $R^*_{460}$ | | Residual Fat | | $R^*_{460}$ | | Residual Fat | |
| −L | +L | −L | +L | −L | +L | −L | +L | −L | +L | −L | +L |
| 63.8 | 68.8 | 5.73 | 4.88 | 62.2 | 68.2 | 5.17 | 3.40 | 70.3 | 76.5 | 4.44 | 1.21 |

EXAMPLE 4

With the composition of Example 1, washing experiments were carried out with different lipases in a Tergotometer, at a concentration of 2 g/l in water of 17° GH, with a lipase concentration of 1 LU/ml, using cotton as test cloth and a mixture of palm oil and milk powder as soil. The reflectance and % fatty matter were determined after the fourth wash.

The following results were obtained:

| Lipase | IgG reaction | $R^*_{460}$ | % FM |
|---|---|---|---|
| None | — | 56.9 | 20.3 |
| Amano-P | + | 69.5 | 10.9 |
| Toyo Jozo | + | 69.4 | 10.6 |
| Diosynth | + | 69.9 | 10.7 |
| Amano CE (ex *Humicola lanuginosa*) | — | 65.7 | 13.8 |
| Amano AP 6 (ex *Aspergillus niger*) | — | 57.6 | 19.5 |
| Esterase MM (ex *Mucor mihei*) | — | 67.6 | 12.6 |
| Lipase ex *Candida cylindraceae* | — | 60.7 | 18.2 |
| Lipase ex *Mucor mihei* | — | 65.6 | 14.3 |
| Lipase MY (ex *Candida cylindraceae*) | — | 58.3 | 19.5 |
| Lipase ex *Fusarium oxysporum* | — | 61.1 | 16.8 |

The foregoing table sets forth the immunological crossreaction result which each lipase has with the antibody of the lipase produced by the microorganism *Pseudomonas fluorescens* IAM 1057. The (+) indicates a positive cross-reaction while the (−) indicates a negative cross-reaction.

We claim:

1. A lipase-containing fabric cleaning detergent composition which composition provides improved detergency and which composition comprises:

(1) from 1% to 40% of an anionic synthetic detergent active material wherein said anionic detergent is the sole detergent active material in the composition;

(2) from 1% to 55% of a builder, wherein the builder is a water soluble salt;

(3) a lipase enzyme selected from the group of enzymes consisting of enzymes produced by strains of the Pseudomonas and the Chromobacter genus, except that the enzyme is not produced by the microorganisms *Pseudomonas fragi* or *Pseudomonas nitroducens* var. *lipolyticum*, wherein said enzyme shows a positive immunological cross-reaction with the antibody of a lipase produced by the microorganism *Pseudomonas fluorescens* IAM 1057; and (4) from 1% to 35% of a bleaching agent said composition containing the enzyme in an amount that the final composition has a lipolytic activity of from 0.005 to 100 Lipase Units per milligram;

wherein components (1) through (4) are formulated in a complete detergent composition and none of the components is separately applied to fabric in a prewash or soaking step.

2. A composition according to claim 1, wherein the builder is pentasodium tripolyphosphate.

3. A composition according to claim 1, wherein the builder is sodium carbonate.

4. A composition according to claim 1, wherein the builder is a mixture of pentasodium tripolyphosphate and sodium carbonate in a ratio of 20:1 to 1:20.

5. A composition according to claim 1, wherein the enzyme also shows a positive immunological cross-reaction with the antibody of the lipase produced by the microorganism *Chromobacter viscosum* var. *lipolyticum* NRRLB 3673 or *Pseudomonas gladioli.*

6. A composition according to claim 1 further containing a proteolytic enzyme, said composition containing the proteolytic enzyme in such an amount that the final composition has a proteolytic activity of from 0.005 to 100 Lipase Units per milligram.

* * * * *